US009227445B2

(12) United States Patent
Murata et al.

(10) Patent No.: US 9,227,445 B2
(45) Date of Patent: Jan. 5, 2016

(54) PRINTING DEVICE

(71) Applicant: Seiko Epson Corporation, Tokyo (JP)

(72) Inventors: Shoichi Murata, Higashichikuma-gun (JP); Kenichi Hirabayashi, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/557,846

(22) Filed: Dec. 2, 2014

(65) Prior Publication Data

US 2015/0165801 A1 Jun. 18, 2015

(30) Foreign Application Priority Data

Dec. 13, 2013 (JP) ..... 2013-258030

(51) Int. Cl.
*B41J 29/13* (2006.01)
*B41J 29/02* (2006.01)

(52) U.S. Cl.
CPC ..... *B41J 29/02* (2013.01)

(58) Field of Classification Search
CPC ..... B41J 29/02; B41J 29/13
USPC ..... 347/108
See application file for complete search history.

(56) References Cited

FOREIGN PATENT DOCUMENTS

JP 07-329398 A 12/1995
JP 2001-019177 A 1/2001

*Primary Examiner* — Justin Seo
*Assistant Examiner* — Michael Konczal

(57) ABSTRACT

A printing device has an outside cover 17 that pivots in a closing direction from an open position and moves to a closed position; a stationary-side pressure lever 32 that rotates in the same direction as the closing direction from a stationary-side release position where a stationary-side media pressure part is separated from the conveyance path surface, and moves to a stationary-side pressure position wherein roll paper is pressed to the conveyance path surface by the stationary-side media pressure part when the outside cover 17 rotates in the closing direction; and a movable-side pressure lever 52 that rotates in the opposite direction as the closing direction from a movable-side release position where a movable-side media pressure part is separated from the conveyance path surface, and moves to a movable-side pressure position wherein roll paper is pressed to the conveyance path surface by the movable-side media pressure part when the outside cover 17 rotates in the closing direction.

11 Claims, 10 Drawing Sheets

PRINTING DEVICE

CROSS-REFERENCE TO RELATED APPLICATION(S)

This application claims priority under 35 U.S.C. §119 on Japanese application no. 2013-258030 filed Dec. 13, 2013, the content of which is hereby incorporated by reference in its entirety.

BACKGROUND

1. Technical Field

The present invention relates to a printing device having a pressure lever that presses the print medium to the conveyance path surface.

2. Related Art

Printers that have a main cover that can open and close attached to a housing, and a paper guide that can open and close disposed to the inside of the main cover, and prevent conveying paper while the paper guide is not completely closed by preventing closing the main cover when the paper guide is not completely closed (is partially open), are known from the literature. See, for example, JP-A-H07-329398.

However, because the main cover cannot be closed when the user tries to close the main cover if the paper guide is not completely closed in the printer according to the related art, the main cover must be reopened, the paper guide completely closed, and the main cover then closed again. This operation is complicated and non-intuitive.

SUMMARY

A printing device according to the present invention prevents print media being conveyed when the pressure lever is not in the pressure position without the user needing to perform a complicated operation.

A printing device according to one aspect of the invention has an outside cover that rotates in a closing direction from an open position where the inside of the printing device is open to a closed position where the inside of the printing device is closed; a first pressure lever; and a second pressure lever.

The first pressure lever has a first media pressure part that presses the print medium to the conveyance path surface. When the outside cover rotates in the closing direction, the first pressure lever rotates in the same direction as the closing direction from a first release position where the first media pressure part is separated from the conveyance path surface, and moves to a first pressure position where the first media pressure part presses the print medium to the conveyance path surface.

The second pressure lever has a second media pressure part that presses the print medium to the conveyance path surface. When the outside cover rotates in the closing direction, the second pressure lever rotates in the opposite direction as the closing direction from a second release position where the second media pressure part is separated from the conveyance path surface, and moves to a second pressure position where the second media pressure part presses the print medium to the conveyance path surface.

Thus comprised, if the user rotates the outside cover in the closing direction while either or both the first pressure lever and the second pressure lever are still at the release position, the first pressure lever rotates in the same direction as the closing direction, and the second pressure lever rotates in the opposite direction as the closing direction and moves to the second pressure position, in conjunction with the outside cover rotating in the closing direction. More specifically, a first pressure lever and second pressure lever that rotate in opposite directions can be positioned to the first pressure position and the second pressure position, respectively, by simply closing the outside cover. The print medium being conveyed when the first pressure lever and the second pressure lever are not at the first pressure position and the second pressure position can therefore be prevented without the user performing a complicated operation.

In another aspect of the invention, the outside cover preferably has a first engaging part that engages the first pressure lever set to the first release position and rotates the first pressure lever in the same direction as the closing direction when the outside cover rotates in the closing direction from the open position, and a second engaging part that engages the second pressure lever set to the second release position and rotates the second pressure lever in the opposite direction as the closing direction when the outside cover rotates in the closing direction from the open position.

Thus comprised, by the first engaging part engaging the first pressure lever at the first release position when the outside cover pivots in the closing direction from the open position, the first pressure lever rotates in the same direction as the closing direction to the first pressure position, and by the second engaging part engaging the second pressure lever at the second release position, the second pressure lever rotates in the opposite direction as the closing direction and moves to the second pressure position. The first pressure lever and the second pressure lever can therefore be respectively positioned to the first pressure position and the second pressure position by simply closing the outside cover.

Further preferably in another aspect of the invention, the first pressure lever has a lever main to which the first media pressure part is disposed, and an engagement receiving part that the first engaging part engages; and the engagement receiving part engages the first engaging part on the opposite side of the axis of rotation of the first pressure lever as the first media pressure part.

Thus comprised, even in a construction in which the first engaging part engages the first pressure lever on the first media pressure part side of the axis of rotation, and rotating the first pressure lever in the same direction as the closing direction is difficult, the first pressure lever can be rotated in the same direction as the closing direction by the engagement receiving part engaging the first engaging part on the opposite side of the axis of rotation of the first pressure lever as the first media pressure part.

In another aspect of the invention, the second engaging part engages the second pressure lever on the opposite side of the axis of rotation of the second pressure lever as the second media pressure part.

Thus comprised, even in a construction in which the second engaging part engages the second pressure lever on the second media pressure part side of the axis of rotation, and rotating the second pressure lever in the opposite direction as the closing direction is difficult, the second pressure lever can be rotated in the opposite direction as the closing direction by engaging the second pressure lever on the opposite side of the axis of rotation of the second pressure lever as the second media pressure part.

In another aspect of the invention, the lever main and the engagement receiving part are formed in unison.

By integrally forming the engagement receiving part and the lever main, the parts count does not increase. As a result, the cost increase resulting from using an engagement receiving part can be suppressed.

Further preferably in another aspect of the invention, when the outside cover is in the closed position, the first engaging part is disengaged from the first pressure lever which has reached to the first pressure position; and the second engaging part of the outside cover in the closed position is disengaged from the second pressure lever which has reached the second pressure position.

Thus comprised, the outside cover and the first pressure lever do not touch, and the outside cover and the second pressure lever do not touch, when the outside cover is in the closed position. As a result, when the printing process is executed with the outside cover at the closed position, the effect of vibration or other external disturbance of the outside cover through the first pressure lever or the second pressure lever on conveyance of the print medium can be suppressed.

A printing device according to another aspect of the invention preferably also has a first elastic member that urges the first pressure lever to the first pressure position and the first release position from a neutral position between the first pressure position and the first release position; and a second elastic member that urges the second pressure lever to the second pressure position and the second release position from a neutral position between the second pressure position and the second release position.

Thus comprised, when the first engaging part engages the first pressure lever at the first release position and the first pressure lever rotates to the neutral position, the first pressure lever is urged by the first elastic member toward the first pressure position, and the first pressure lever therefore separates from the first engaging part and rotates to the first pressure position.

Likewise, when the second engaging part engages the second pressure lever at the second release position and the second pressure lever rotates to the neutral position, the second pressure lever is urged by the second elastic member toward the second pressure position, and the second pressure lever therefore separates from the second engaging part and rotates to the second pressure position.

The outside cover and the first pressure lever therefore do not touch, and the outside cover and the second pressure lever do not touch, when the outside cover is at the closed position.

Further preferably, the printing device also has a conveyance unit that conveys the print medium; an open/closed detection sensor that detects whether or not the outside cover is at the closed position; and a control unit that prohibits driving the conveyance unit when the open/closed detection sensor detects that the outside cover is not at the closed position.

Thus comprised, the control unit prohibits driving the conveyance unit when the open/closed detection sensor detects that the outside cover is not in the closed position. Therefore, the first pressure lever and the second pressure lever therefore remain at the first pressure position and the second pressure position if the user forgets to return the first pressure lever and the second pressure lever to the first pressure position and the second pressure position, and also forgets to close the outside cover, but because driving the conveyance unit is prohibited, the print medium can be prevented from being conveyed when the first pressure lever and the second pressure lever are not at the first pressure position and the second pressure position.

Further preferably, the printing device also has a first guide unit that guides one edge of the width of the print medium, and a second guide unit that guides the other edge of the width of the print medium; and the first pressure lever is disposed to the first guide unit, and the second pressure lever is disposed to the second guide unit.

Thus comprised, the first guide unit and the second guide unit can suppress the print medium from skewing and meandering.

A printing device according to another aspect of the invention includes a movable guide that can move in a transverse direction perpendicular to the conveyance direction of a print medium, and guides one side edge of the print medium; a pressure lever including a pressure part that presses the print medium to the conveyance path surface, is disposed to the movable guide rotatably between a release position where the pressure part is separated from the conveyance path surface and a pressure position where the print medium is pressed to the conveyance path surf ace by the pressure part, and moves in the transverse direction in conjunction with movement of the movable guide; and an outside cover including an engaging part that engages the pressure lever in the release position and rotates the pressure lever to the pressure position when the outside cover rotates in a closing direction from an open position where the inside of the printing device is open to a closed position where the inside of the printing device is closed; the engaging part being able to engage the pressure lever wherever the pressure lever is located in the range of movement on the transverse axis.

Thus comprised, when the outside cover rotates in the closing direction from the open position, the engaging part engages the pressure lever set to the release position and can thereby rotate the pressure lever to the pressure position regardless of where the pressure lever is located in the range of movement on the transverse axis. As a result, the pressure lever can be set to the pressure position by simply closing the outside cover. Conveying the print medium when the pressure lever is not at the pressure position can therefore be prevented without the user performing a complicated operation.

Other objects and attainments together with a fuller understanding of the invention will become apparent and appreciated by referring to the following description and claims taken in conjunction with the accompanying drawings.

DESCRIPTION OF EMBODIMENTS

A preferred embodiment of a printer according to the present invention is described below with reference to the accompanying figures. The printer described in this embodiment is an inkjet printer that prints images on roll paper or other print medium based on print data sent from an information processing device such as a personal computer or mobile device.

Note that the invention is described below with reference to the top, bottom, left, right, front, and rear directions shown in the figure, but these directions are used for convenience of description only and embodiments of the invention are obviously not limited to these directions.

Figure 1A:
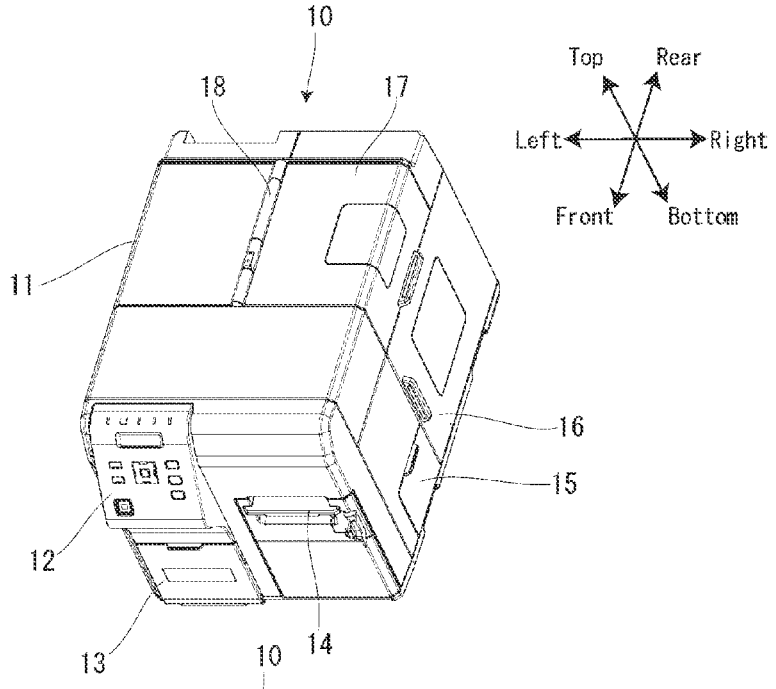
FIG. 1 is an external oblique view of a printer according to a preferred embodiment of the invention, (a) showing the outside cover in the closed position and (b) showing the printer when the outside cover has been removed.
Figure 1B:
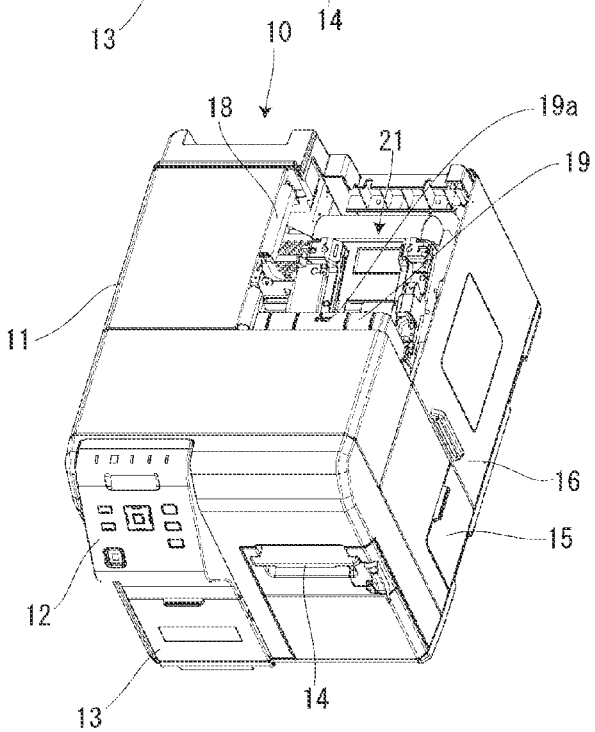

As shown in FIG. 1, a printer 10 according to this embodiment of the invention has a basically box-like case 11. A display and operating panel 12 having a display and operating buttons, for example, is disposed to the left top part of the front of the case 11. A drawer-type ink cartridge replacement opening 13 is formed below the display and operating panel 12. A paper exit 14 that is a slot long on the left-right axis is formed in the middle on the right side of the front of the case 11. The printed roll paper P is discharged from the paper exit 14.

A waste ink tank replacement opening 15 is disposed at the front bottom part of the right side of the case 11. A large roll paper supply opening 16 is disposed behind the waste ink tank replacement opening 15 to the rear side of the case 11. A roll paper loading unit 20 (see FIG. 2) is disposed inside the roll paper supply opening 16. The user loads roll paper P that has been wound so it can be supplied to the paper conveyance path is loaded from the roll paper supply opening 16 into the roll paper loading unit 20.

An outside cover 17 is also disposed to the case 11 from above the roll paper supply opening 16 to the top of the case 11, and can open and close access to the inside of the case by pivoting on a hinge 18 disposed substantially in the middle of the top of the case 11. The outside cover 17 pivots between an open position that exposes the inside of the case, and a closed position where it closes access to the inside of the case. More specifically, the outside cover 17 rotates from the open position counterclockwise as seen from the back to the closed position (see FIG. 4 to FIG. 9). The direction of rotation from the open position of the outside cover 17 to the closed position is referred to herein as the closing direction. The outside cover 17 is described in further detail below.

Opening the outside cover 17 exposes a guide unit 21 and a shield wall 19 disposed in front of the guide unit 21. The guide unit 21 guides conveyance of the roll paper P. The shield wall 19 separates the space above the guide unit 21 from the print unit 23 (see FIG. 2) disposed in front of the guide unit 21.

A rectangular open/closed detection opening 19*a* is formed approximately in the middle of the top of the shield wall 19. An open/closed detection sensor (not shown in the figure) that detects if the outside cover 17 is open or closed is disposed inside the open/closed detection opening 19*a*. This open/closed detection sensor detects whether or not the outside cover 17 is in the closed position. The open/closed detection sensor may be configured using a limit switch or a photosensor, for example.

Figure 2:
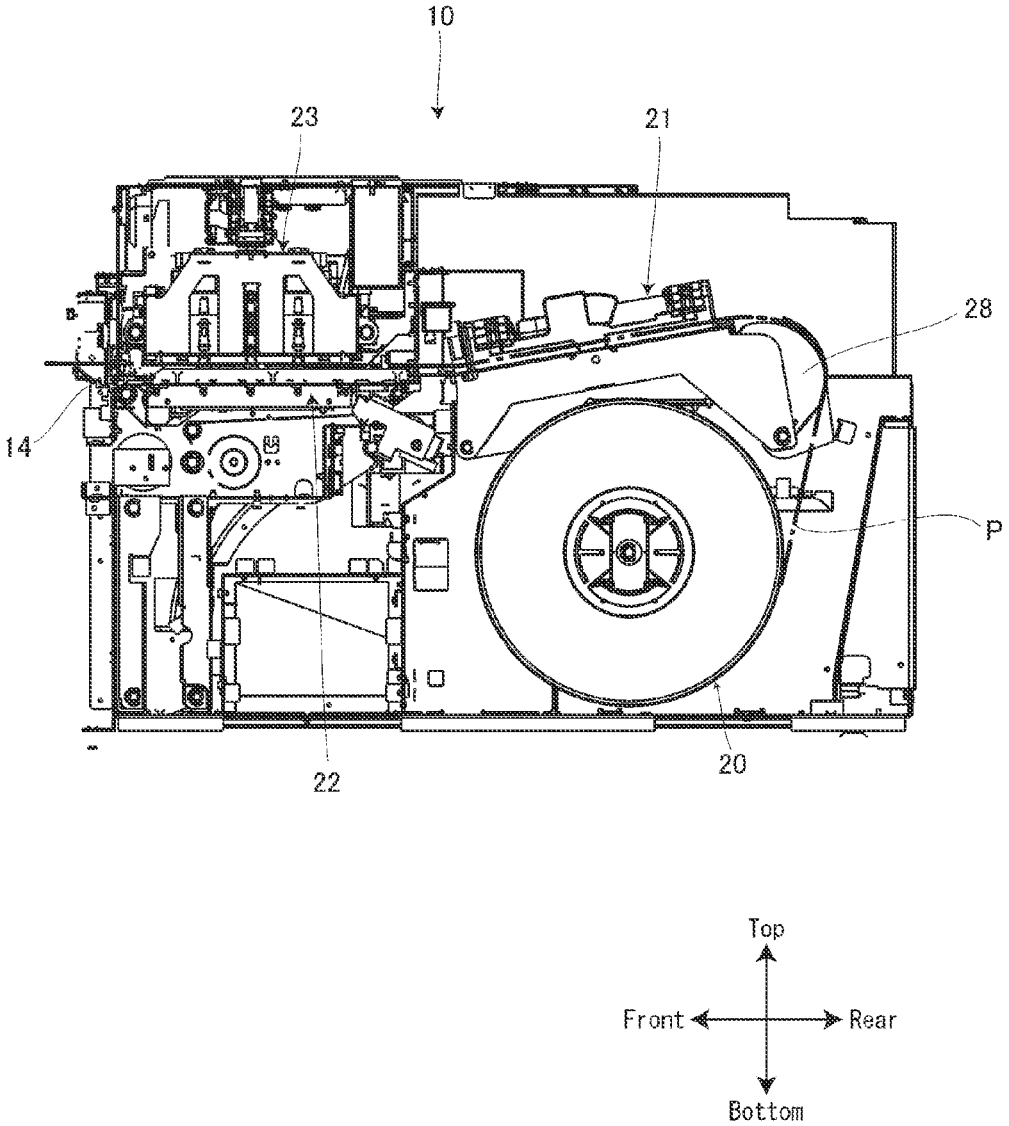
FIG. 2 is a vertical section view of the printer.

As shown in FIG. 2, the printer 10 includes the roll paper loading unit 20, the guide unit 21 disposed above the roll paper loading unit 20, a conveyance unit 22 that delivers and conveys the roll paper P from the roll paper loading unit 20, the print unit 23 that prints with an inkjet head on the conveyed roll paper P, and a control unit (not shown in the figure) that centrally controls these other parts.

Figure 3:
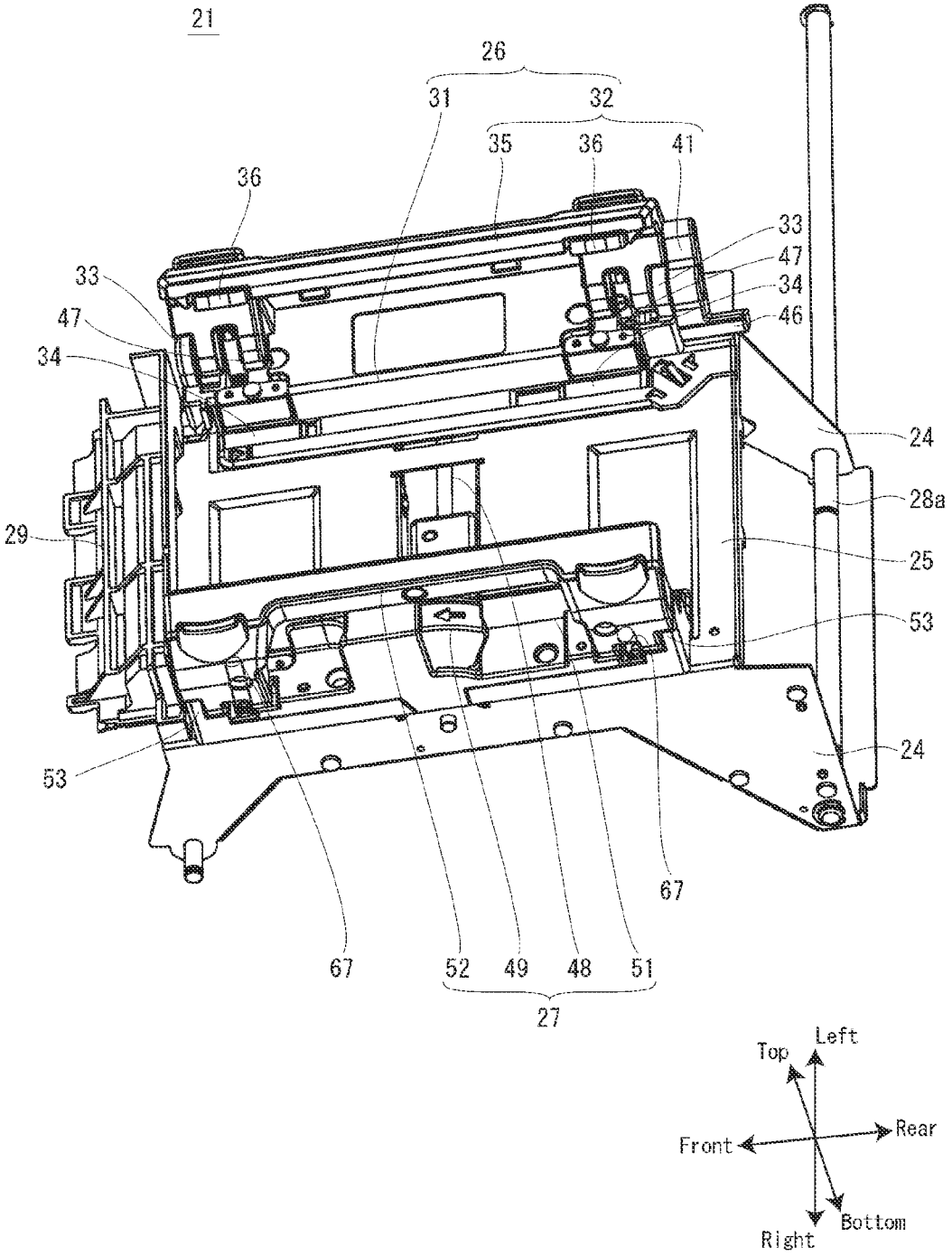
FIG. 3 is an oblique view of a guide unit with the stationary-side pressure lever in the stationary-side release position, and the movable-side pressure lever in the movable-side release position.

As shown in FIG. 3, the guide unit 21 includes left and right support frames 24, a substantially rectangular conveyance plate 25 disposed spanning between the left and right support frames 24, a stationary unit 26 disposed on the left side part of the conveyance plate 25, and a movable unit 27 disposed on the right side part of the conveyance plate 25. The top surface of the conveyance plate 25 is the conveyance path surface over which the roll paper P delivered from the roll paper loading unit 20 is conveyed. The roll paper P is conveyed over the top of the conveyance plate 25 toward the paper exit 14, that is, forward to the front.

A tension rod 28*a* is fixed at the rear end part of the support frames 24. A tension lever 28 (see FIG. 2) that applies appropriate tension to the roll paper P conveyed from the roll paper loading unit 20 over the top of the conveyance plate 25 is pivotably supported on the tension rod 28*a*.

A roller cover 29 is disposed to the top front end part of the conveyance plate 25. A conveyance roller (not shown in the figure) that conveys the roll paper P delivered from the roll paper loading unit 20 to the print unit 23 is housed in the roller cover 29. When setting the roll paper P on the conveyance plate 25, the user sets the leading end of the roll paper P delivered from the roll paper loading unit 20 against the conveyance roller.

The stationary unit 26 includes a stationary guide 31 fastened to the left side part of the conveyance plate 25, and a stationary-side pressure lever 32 that is disposed to the stationary guide 31 and applies pressure to the left side of the roll paper P.

Note that the stationary guide 31 is an example of a first guide unit in the accompanying claims. The stationary-side pressure lever 32 is an example of a first pressure lever in the accompanying claims.

The left edge of the roll paper P conveyed over the conveyance plate 25 contacts the stationary guide 31. The stationary guide 31 guides the roll paper P that is conveyed over the conveyance plate 25 between the stationary guide 31 and a movable guide 51 described below.

The stationary guide 31 includes two stationary-side pressure lever pivot parts 33, one each at the front and back ends, and two stationary-side pressure bearing parts 34, one each at the front and back ends. The stationary-side pressure lever pivot parts 33 pivotably support the stationary-side pressure lever 32. The stationary-side pressure bearing parts 34 are the parts that receive the pressure of the stationary-side pressure lever 32 on the left side of the roll paper P. The tops of the stationary-side pressure bearing parts 34 and the top of the conveyance plate 25 together form part of the conveyance path surface.

The stationary-side pressure lever 32 includes a stationary-side lever main 35 that is basically U-shaped in a right side view, stationary-side media pressure parts 36 at two (front and back) locations at the distal end of the stationary-side lever main 35, and an engagement receiving member 41 attached to the back side of the stationary-side lever main 35.

Note that the stationary-side media pressure parts 36 are an example of a first media pressure part in the accompanying claims.

The stationary-side pressure lever 32 presses the left side of the roll paper P to the top of the stationary-side pressure bearing parts 34 by means of the two front and back stationary-side media pressure parts 36 while allowing conveyance of the roll paper P. More specifically, the roll paper P is conveyed with the left side thereof held down by the stationary-side pressure lever 32 against the top of the stationary-side pressure bearing parts 34.

The stationary-side pressure lever 32 is configured pivotably on the stationary-side pressure lever pivot parts 33 between a stationary-side release position (see FIG. 4) where the stationary-side media pressure parts 36 are separated from the stationary-side pressure bearing parts 34, and a stationary-side pressure position (see FIG. 5) where the roll paper P is pressed against the top of the stationary-side pressure bearing parts 34 by the stationary-side media pressure parts 36. More specifically, the stationary-side pressure lever 32 pivots counterclockwise when seen from the back from the stationary-side release position to the stationary-side pressure position (see FIG. 4 and FIG. 5). The direction of rotation of the stationary-side pressure lever 32 from the stationary-side release position to the stationary-side pressure position is the same as the closing direction of the outside cover 17.

Note that the stationary-side release position is an example of the first release position in the accompanying claims, and the stationary-side pressure position is an example of the first pressure position in the accompanying claims.

Figure 4:
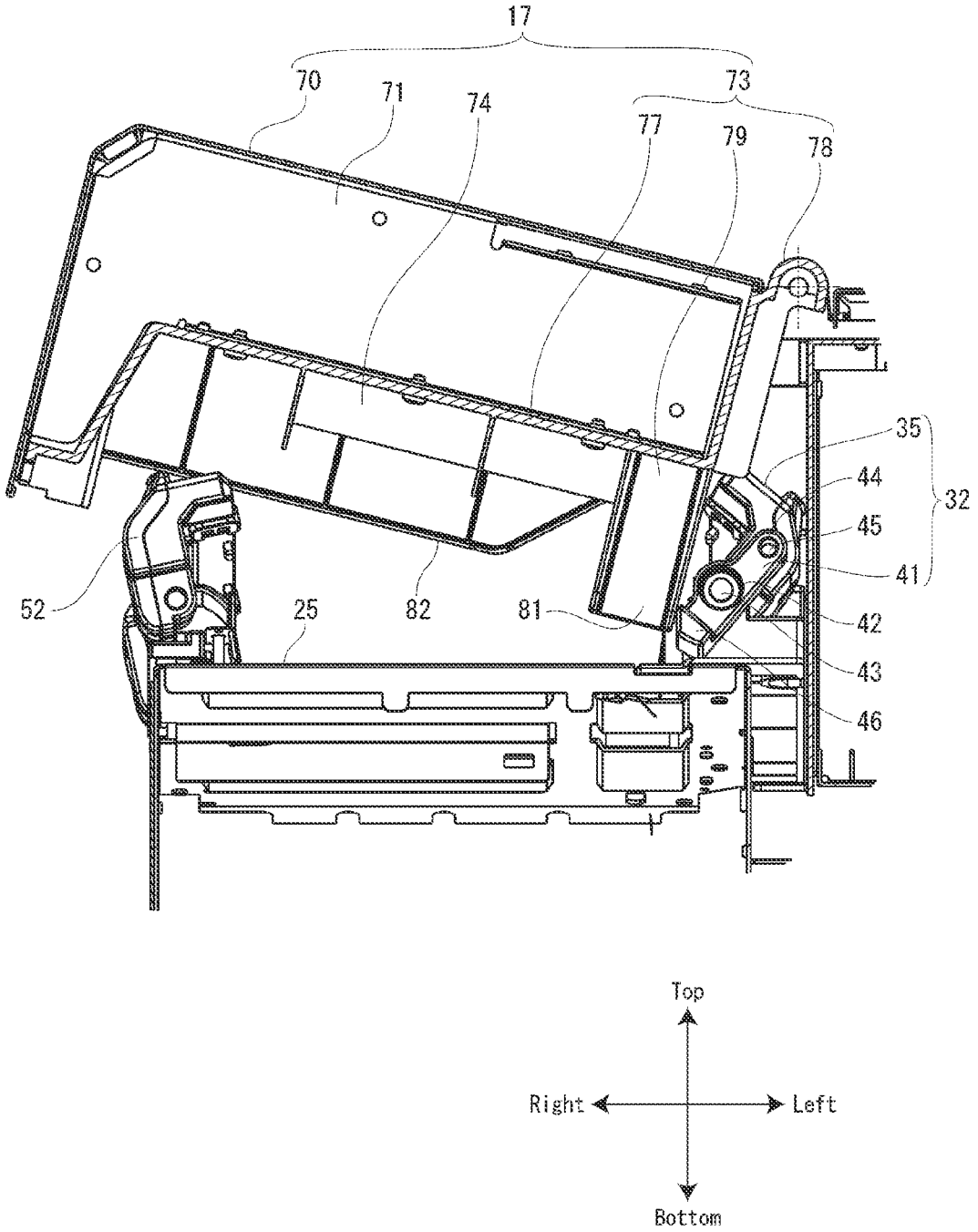
FIG. 4 is a back section view of the guide unit and the outside cover through the back part of the guide unit when the stationary-side pressure lever is in the stationary-side release position and the movable-side pressure lever is in the movable-side release position.
Figure 5:
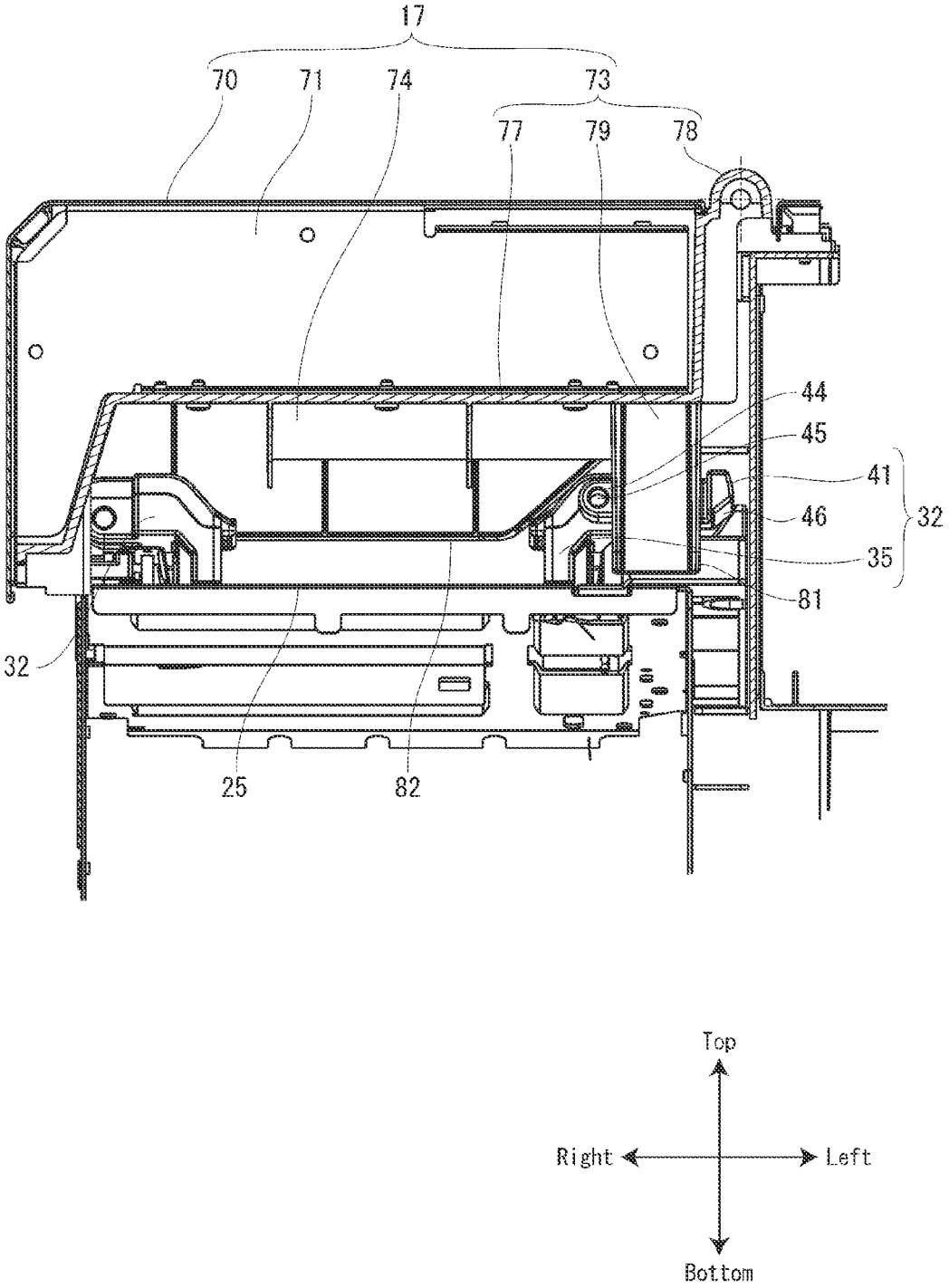
FIG. 5 shows the stationary-side pressure lever moved from the position shown in FIG. 4 to the stationary-side pressure position and the movable-side pressure lever moved to the movable-side pressure position.

As shown in FIG. 4 and FIG. 5, the engagement receiving member 41 has a basically oval shape when seen from the back.

The engagement receiving member 41 is supported pivotably on the rear stationary-side pressure lever pivot part 33 by a small screw 43 passing through a screw hole 42 formed approximately in the middle. The engagement receiving member 41 is also fastened to the back of the stationary-side lever main 35 by a pin 45 passing through a hole 44 formed in one end of the engagement receiving member 41. The engagement receiving member 41 pivots on the stationary-side pressure lever pivot parts 33 in unison with the stationary-side lever main 35, which pivots between the stationary-side release position and the stationary-side pressure position. The other end part of the engagement receiving member 41 curves to the back (see FIG. 3).

When the stationary-side pressure lever 32 is at the stationary-side release position and the waste ink tank replacement opening 15 pivots from the open position to the closed position, the stationary-side engagement part 81 (described below) of the outside cover 17 engages the other end of the engagement receiving member 41. This other end of the engagement receiving member 41 is thus a stationary-side engagement receiving member 46 that the stationary-side engagement part 81 engages. This stationary-side engagement receiving member 46 is positioned on the opposite side of the axis of rotation of the stationary-side pressure lever 32, that is, the stationary-side pressure lever pivot parts 33, as the stationary-side media pressure parts 36.

Note that the stationary-side lever main 35 and the stationary-side engagement receiving member 46 may be formed in unison. Because the parts count does not increase in this event, the cost increase resulting from disposing the stationary-side engagement receiving member 46 can be suppressed.

When the roll paper P is conveyed for a printing process, for example, the user pivots the stationary-side pressure lever 32 to the stationary-side pressure position. As a result, the roll paper P is conveyed with the left edge thereof held by the stationary-side pressure lever 32. When setting the roll paper P on the conveyance plate 25, the user pivots the stationary-side pressure lever 32 to the stationary-side release position. As a result, the user can easily set the roll paper P on the conveyance plate 25. Note that the user likewise pivots the movable-side pressure lever 52 described below.

As shown in FIG. 3, a stationary-side lever spring 47 is disposed to two (front and rear) positions on the stationary-side pressure lever 32. The stationary-side lever springs 47 are tension springs with the top ends held by the stationary-side lever main 35 and the bottom ends held by the stationary-side pressure lever pivot parts 33. The stationary-side lever springs 47 function as so-called bi-stable springs. As a result, the stationary-side pressure lever 32 is urged by the stationary-side lever springs 47 to either the stationary-side pressure position or the stationary-side release position from the neutral point between the stationary-side pressure position and the stationary-side release position.

Note that the stationary-side lever springs 47 are an example of a first elastic member in the accompanying claims.

The movable unit 27 includes a guide rail 48 extending on the left-right (transverse) axis, a movable guide 51 disposed so that it can swing left and right on the guide rail 48, a lock release lever 49 for locking and unlocking the movable guide 51 to the guide rail 48, and a movable-side pressure lever 52 that is disposed to the movable guide 51 and applies pressure to the right side of the roll paper P.

Note that the movable guide 51 is an example of a second guide unit in the accompanying claims, and the movable-side pressure lever 52 is an example of a second pressure lever in the accompanying claims.

The right edge of the roll paper P conveyed over the conveyance plate 25 contacts the movable guide 51. The movable guide 51 guides the roll paper P conveyed over the conveyance plate 25 between the movable guide 51 and the stationary guide 31. The movable guide 51 is normally locked to the guide rail 48. When the user rotates the lock release lever 49 forward, the movable guide 51 is unlocked from the guide rail 48 and can slide left and right on the guide rail 48. The user can then slide the movable guide 51 widthwise to the paper, that is, in the left-right direction perpendicular to the conveyance direction (front-rear direction) to adjust the guide width to the width of the roll paper P. Note that when sliding the movable guide 51 left or right, the movable-side pressure lever 52 disposed to the movable guide 51 also slides in the same direction.

Figure 8:
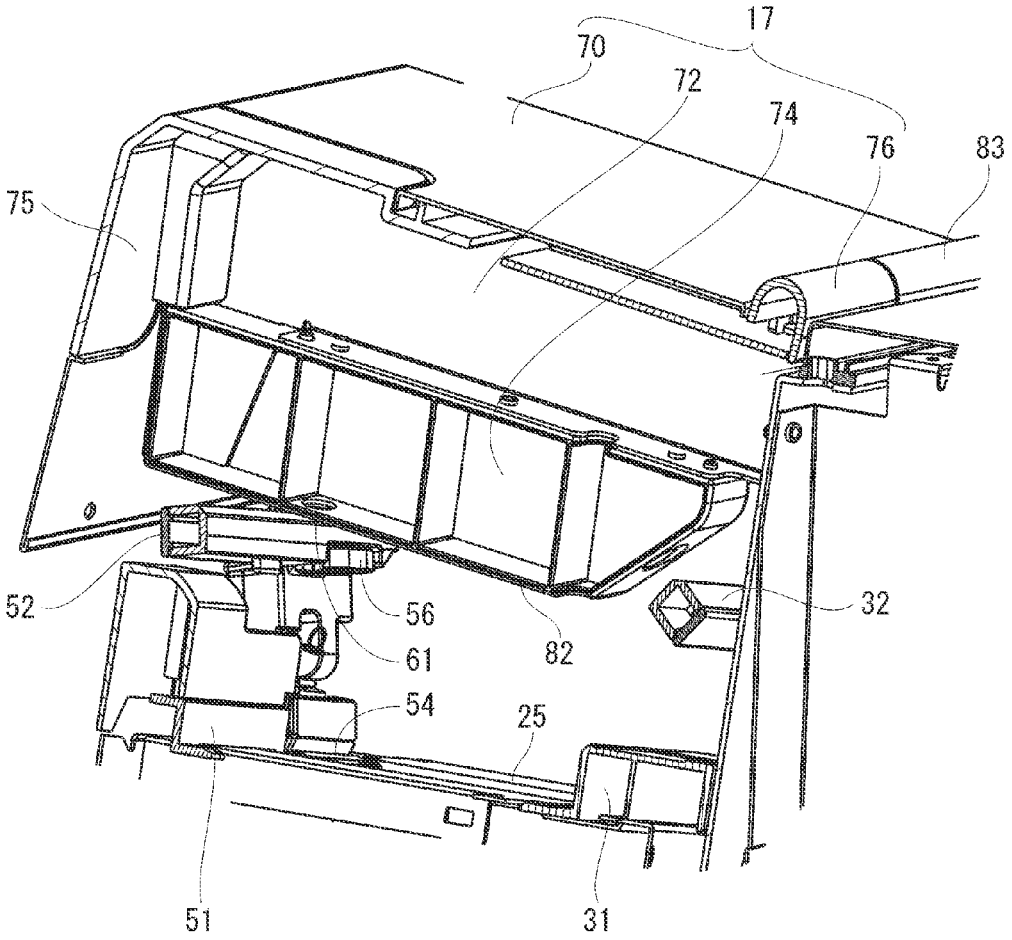
FIG. 8 is a section view from a different angle than shown in FIG. 6.
Figure 9:
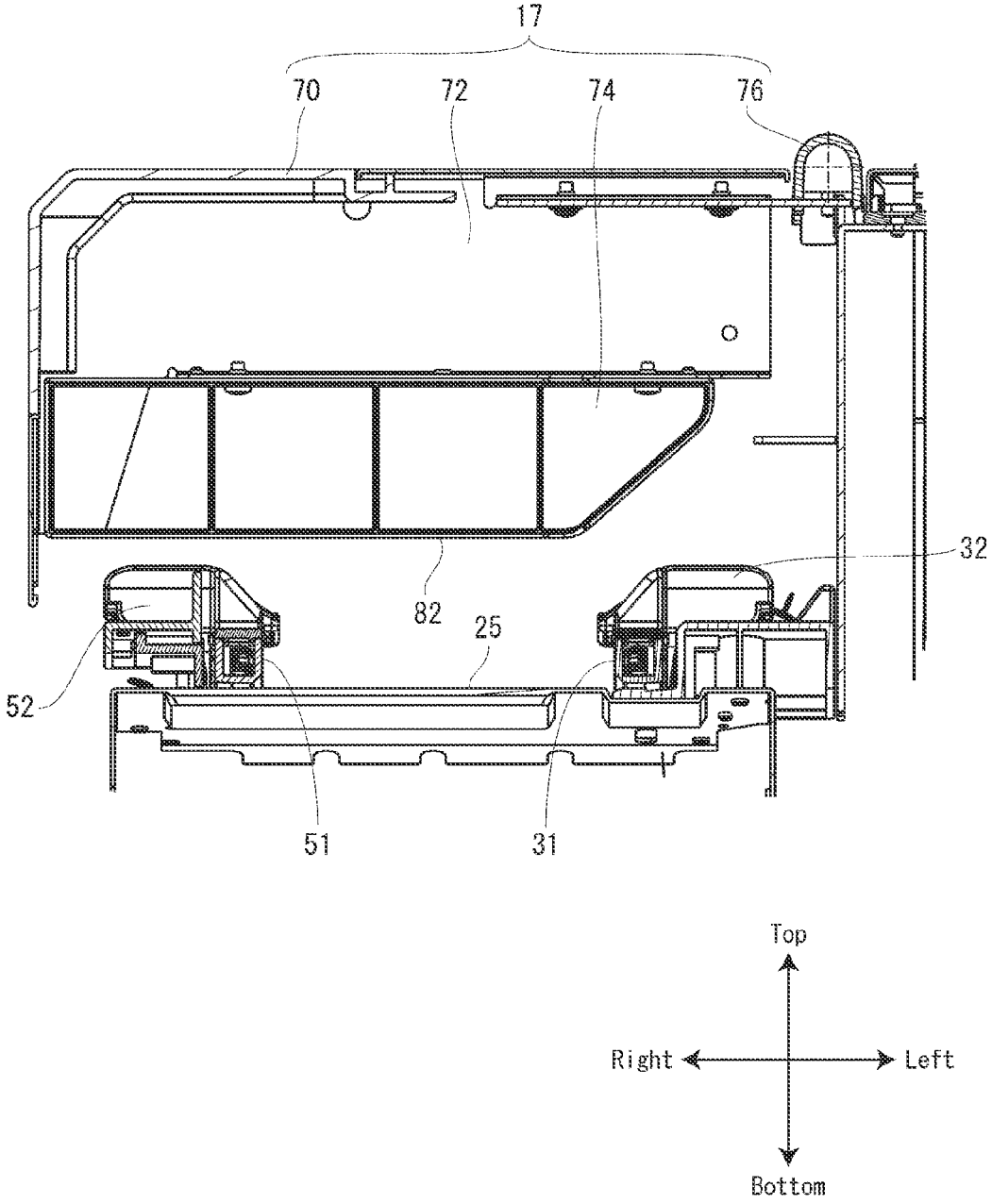
FIG. 9 shows the stationary-side pressure lever moved from the position shown in FIG. 6 to the stationary-side pressure position, and the movable-side pressure lever moved to the movable-side pressure position.

Like the stationary guide 31, the movable guide 51 has two movable-side pressure lever pivot parts 53, one each at the front and back ends, and two movable-side pressure bearing parts 54, one each at the front and back ends (see FIG. 8). The movable-side pressure lever pivot parts 53 pivotably support the movable-side pressure lever 52. The movable-side pressure bearing parts 54 are the parts that receive the pressure of the movable-side pressure lever 52 on the right side of the roll paper P. The tops of the movable-side pressure bearing parts 54 and the top of the conveyance plate 25 together form part of the conveyance path surface.

The movable-side pressure lever 52 is basically U-shaped in a right side view. Movable-side media pressure parts 56 are formed at two (front and back) locations at the distal end of the movable-side pressure lever 52 (see FIG. 8). The movable-side pressure lever 52 is similar to the stationary-side lever main 35 described above.

Note that the movable-side media pressure parts 56 are an example of a second media pressure part in the accompanying claims.

Like the stationary-side pressure lever 32 described above, the movable-side pressure lever 52 presses the right side of the roll paper P to the top of the movable-side pressure bearing parts 54 by means of the two front and back movable-side media pressure parts 56 while allowing conveyance of the roll paper P. More specifically, the roll paper P is conveyed with the opposite sides thereof held down against the top of the conveyance plate 25 by the movable-side pressure lever 52 and the stationary-side pressure lever 32. This makes it difficult for the roll paper P to separate from the top of the conveyance plate 25, and can prevent the roll paper P from jamming and the printing position on the paper from shifting.

The movable-side pressure lever 52 can pivot between a movable-side release position (see FIG. 6 to FIG. 8) where the movable-side media pressure parts 56 are separated from the movable-side pressure bearing parts 54, and a movable-side pressure position (see FIG. 9) where the movable-side media pressure parts 56 can hold the roll paper P pressed against the top of the movable-side pressure bearing parts 54. More specifically, the movable-side pressure lever 52 can pivot from the movable-side release position clockwise when seen from the rear to the movable-side pressure position (see FIG. 6 to FIG. 9). The direction of rotation of the movable-side pressure lever 52 from the movable-side release position to the movable-side pressure position is the opposite of the closing direction of the outside cover 17.

Note that the movable-side release position is an example of the second release position in the accompanying claims, and the movable-side pressure position is an example of a second pressure position in the accompanying claims.

When the movable-side pressure lever 52 is at the movable-side release position and the outside cover 17 pivots from the open position to the closed position, the movable-side engagement part 82 (described below) of the outside cover 17 engages the movable-side pressure lever 52 near the front movable-side media pressure part 56 (see FIG. 8). More specifically, this part near the front movable-side media pressure part 56 is the movable-side engagement receiving member 61 that the movable-side engagement part 82 engages. This movable-side engagement receiving member 61 is located on the same side of the axis of rotation of the movable-side pressure lever 52, that is, the movable-side pressure lever pivot parts 53, as the movable-side media pressure parts 56.

A movable-side lever spring 67 is disposed to the movable-side pressure lever 52 at two locations, that is, at the front and rear. Like the stationary-side lever spring 47 described above, the movable-side lever springs 67 are tension springs, the top ends are held by the movable-side pressure lever 52, and the bottom ends are held by the movable-side pressure lever pivot parts 53. The movable-side lever spring 67 function as so-called bi-stable springs. As a result, the movable-side pressure lever 52 is urged by the movable-side lever spring 67 to either the movable-side pressure position or the movable-side release position from the neutral point between the movable-side pressure position and the movable-side release position.

Note that the movable-side lever spring 67 are an example of a second elastic member in the accompanying claims. Note, further, that the movable-side lever spring 67 and the stationary-side lever spring 47 may alternatively be torsion springs or other type elastic member.

The operation whereby the user sets the roll paper P and starts printing is described next.

First, the user opens the outside cover 17, that is, rotates the outside cover 17 to the open position, and exposes the guide unit 21. The user then rotates the stationary-side pressure lever 32 from the stationary-side pressure position to the stationary-side release position, and rotates the movable-side pressure lever 52 from the movable-side pressure position to the movable-side release position. As may be necessary, the user also operates the lock release lever 49 and slides the movable guide 51 to the right so that the roll paper P can be easily passed between the stationary guide 31 and the movable guide 51. The user then sets end of the roll paper P pulled from the roll paper loading unit 20 on the conveyance plate 25.

Next, the user operates the lock release lever 49 and slides the movable guide 51 to adjust the guide width to the width of the roll paper P. Next, the user returns the stationary-side pressure lever 32 from the stationary-side release position to the stationary-side pressure position, and returns the movable-side pressure lever 52 from the movable-side release position to the movable-side pressure position. Finally, the user closes the outside cover 17, that is, swings the outside cover 17 to the closed position.

After completing this operation, the user performs an operation on an external information processing device to execute the printing process. Based on the print commands from the information processing device, the printer 10 starts the printing process. As a result, the roll paper P set on the conveyance plate 25 is fed to the print unit 23 guided by the stationary guide 31 and movable guide 51 while the left and right sides of the paper are held down by the stationary-side pressure lever 32 and the movable-side pressure lever 52.

If the roll paper P is conveyed in the printer 10 with the stationary-side pressure lever 32 and movable-side pressure lever 52 at the stationary-side release position and movable-side release position, respectively, the roll paper P may j am or the printing position on the paper may shift. The printer 10 according to the invention can therefore prevent the roll paper P being conveyed when the stationary-side pressure lever 32 and movable-side pressure lever 52 are not set to the stationary-side pressure position and the movable-side pressure position even if the user closes the outside cover 17 and executes the operation to start the printing process without specifically returning the stationary-side pressure lever 32 and movable-side pressure lever 52 to the stationary-side pressure position and the movable-side pressure position after setting the roll paper P on the conveyance plate 25.

As shown in FIG. 4 to FIG. 9, the outside cover 17 includes a cover main 70, a first plate 71 disposed near the back inside the cover main 70, a second plate 72 disposed near the front inside the cover main 70, a stationary-side operating member 73 attached to the first plate 71, and a movable-side operating member 74 attached to the second plate 72.

Note that the top, bottom, left, and right of the outside cover 17 are referred to below, and these directions reference the outside cover 17 when in the closed position.

The cover main 70 is basically L-shaped when seen from the rear end. The cover main 70 opens and closes the top and right sides of the inside of the printer. A transparent window 75 is disposed at the top right corner of the cover main 70. The user can see through the window 75 to see inside the printer even when the outside cover 17 is in the closed position. A cover-side front hinge member 76 is disposed near the front of the left end of the cover main 70.

While not shown in the figures, a detection tab that enters the open/closed detection opening 19*a* described above when the outside cover 17 is in the closed position is formed protruding from the bottom of the front end part of the cover main 70. Whether or not the outside cover 17 is in the closed position can be detected by the open/closed detection sensor disposed inside the open/closed detection opening 19*a* as a result of this detection tab moving in and out of the open/closed detection opening 19*a* as the outside cover 17 opens and closes.

The first plate 71 is basically L-shaped when seen from the rear end and spans substantially all of the cover main 70 from left to right. The stationary-side operating member 73 is attached to the bottom of the first plate 71.

The stationary-side operating member 73 has an attachment part 77 fastened to the first plate 71, a cover-side rear hinge member 78 disposed to the left end part of the attachment part 77, and a stationary-side engaging tab 79 that protrudes from the bottom near the left side of the attachment part 77.

The cover-side rear hinge member 78, cover-side front hinge member 76, and two device-side hinge members 83 at the front and rear of the case 11 embody the hinge 18. The outside cover 17 pivots on the hinge 18 between the open position and the closed position. The hinge 18 is disposed substantially directly above the stationary-side pressure lever 32. The axis of rotation of the outside cover 17, the axis of rotation of the stationary-side pressure lever 32, and the axis of rotation of the movable-side pressure lever 52 are mutually parallel.

The stationary-side engaging tab 79 is substantially rectangular when seen from the rear. The distal end of the stationary-side engaging tab 79 is the stationary-side engagement part 81 that engages the stationary-side engagement receiving member 46 of the engagement receiving member 41 when the stationary-side pressure lever 32 is in the stationary-side release position.

Note that the stationary-side engagement part 81 is an example of a first engaging part in the accompanying claims.

When the outside cover 17 rotates in the closing direction from the open position, the stationary-side engagement part 81 contacts the stationary-side engagement receiving member 46 just before reaching the closed position (see FIG. 4). As a result, the stationary-side pressure lever 32 rotates in the same direction as the closing direction from the stationary-side release position toward the stationary-side pressure position in resistance to the stationary-side lever springs 47. Because the stationary-side pressure lever 32 is urged by the stationary-side lever spring 47 toward the stationary-side pressure position when the stationary-side pressure lever 32 rotates to the neutral position between the stationary-side release position and the stationary-side pressure position, the stationary-side pressure lever 32 separates from the stationary-side engagement part 81 and rotates to the stationary-side pressure position (see FIG. 5). At the stationary-side pressure position, the stationary-side pressure lever 32 is disengaged from the stationary-side engagement part 81 of the outside cover 17 in the closed position.

The stationary-side pressure lever 32 thus rotates in the same direction as the closing direction and moves to the stationary-side pressure position in conjunction with rotation of the outside cover 17 in the closing direction. In addition, when the outside cover 17 has reached the closed position and the stationary-side pressure lever 32 has reached the stationary-side pressure position, the stationary-side pressure lever 32 and the outside cover 17 do not touch.

The second plate 72 has a horizontally long rectangular shape when seen from the rear, and spans substantially the entire cover main 70 from left to right. The movable-side operating member 74 is attached to the bottom of the second plate 72.

Figure 6:
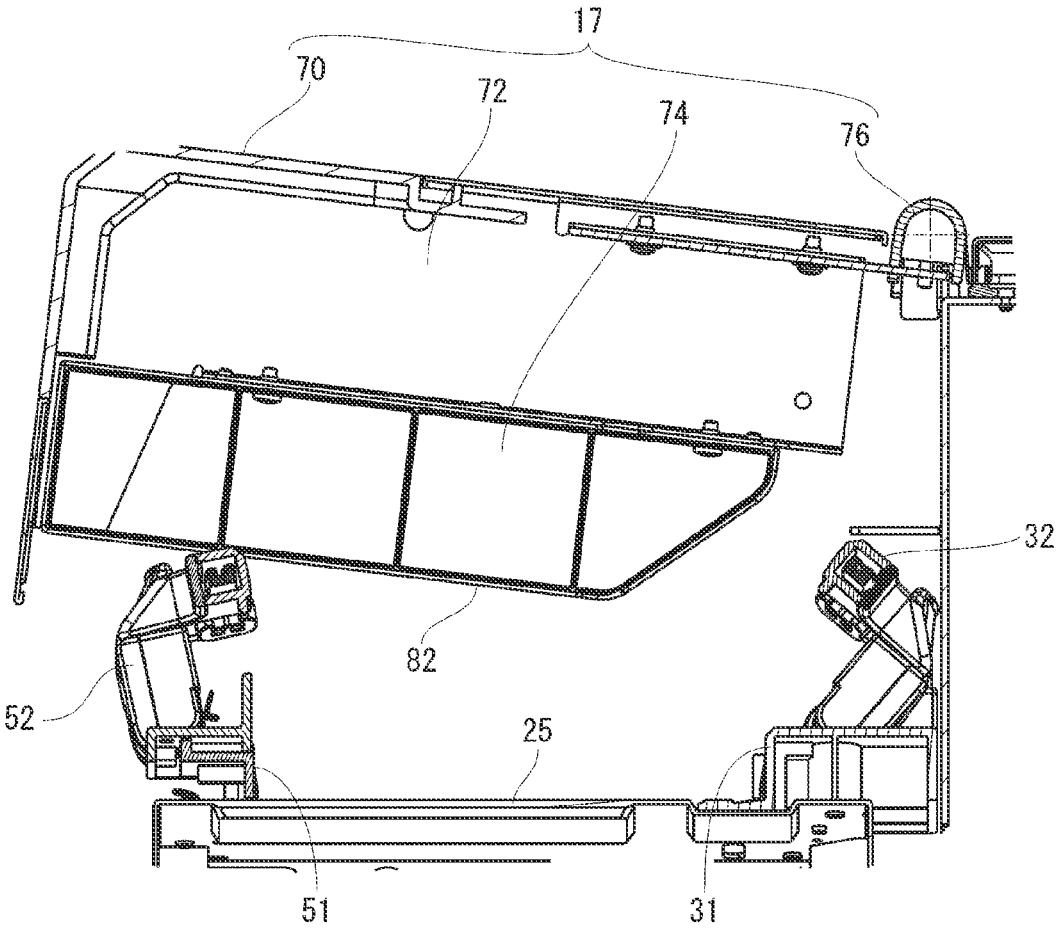
FIG. 6 is a back section view of the guide unit and the outside cover through the front part of the guide unit when the movable guide is at the position farthest from the stationary guide, the stationary-side pressure lever is at the stationary-side release position, and the movable-side pressure lever is at the movable-side release position.
Figure 6:
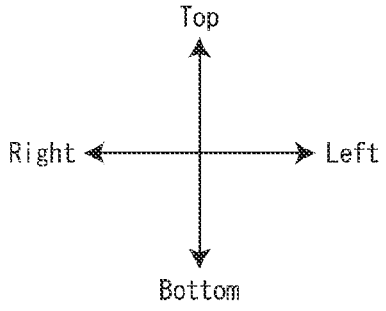
Figure 7:
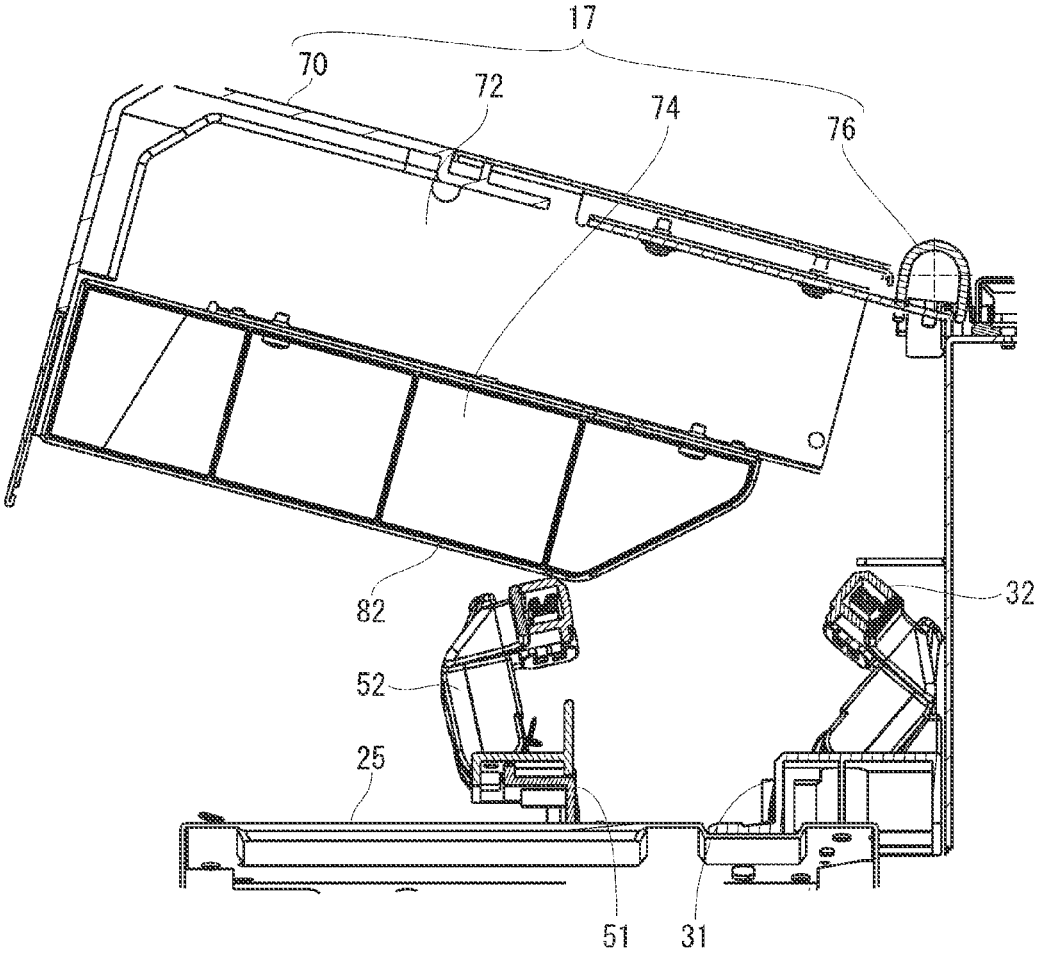
FIG. 7 is a back section view of the guide unit and the outside cover through the front part of the guide unit when the movable guide is at the position closest to the stationary guide, the stationary-side pressure lever is at the stationary-side release position, and the movable-side pressure lever is at the movable-side release position.
Figure 7:
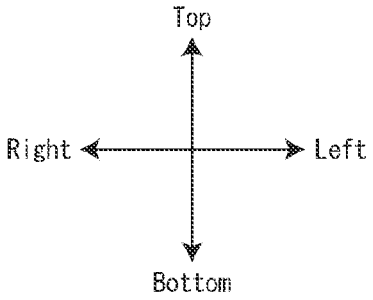

The movable-side operating member 74 has a basically trapezoidal shape with a slope at the bottom left corner when seen from the rear, and has three ribs extending vertically at substantially equal intervals. The bottom of the movable-side operating member 74, that is, the bottom edge portion of the trapezoid, is the movable-side engagement part 82 that engages the movable-side engagement receiving member 61 of the movable-side pressure lever 52 when the movable-side pressure lever 52 is in the movable-side release position. The movable-side engagement part 82 extends left-right. As a result, the movable-side engagement part 82 can engage the movable-side pressure lever 52 wherever the movable-side pressure lever 52 is positioned in its range of movement left and right on the transverse axis. More specifically, the movable-side engagement part 82 engages the movable-side pressure lever 52 even when the movable guide 51 is farthest from the stationary guide 31 and the movable-side pressure lever 52 is positioned at the right end of the range of movement as shown in FIG. 6. As shown in FIG. 7, the movable-side engagement part 82 also engages movable-side pressure lever 52 when the movable guide 51 is closest to the stationary guide 31 and the movable-side pressure lever 52 is at the left end of its range of movement.

Note that the movable-side engagement part 82 is an example of a second engaging part and an engaging part in the accompanying claims.

When the outside cover 17 rotates in the closing direction from the open position, the movable-side engagement part 82 contacts the movable-side engagement receiving member 61 just before the outside cover 17 moves to the closed position (see FIG. 6 to FIG. 8). As a result, the movable-side pressure lever 52 rotates in the opposite direction as the closing direction from the movable-side release position to the movable-side pressure position in resistance to the movable-side lever springs 67. When the movable-side pressure lever 52 reaches the neutral position between the movable-side release position and the movable-side pressure position, the movable-side pressure lever 52 is urged by the movable-side lever springs 67 to the movable-side pressure position, and the movable-side pressure lever 52 therefore separates from the movable-side engagement part 82 and rotates to the movable-side pressure position (see FIG. 9). When the movable-side pressure lever 52 is at the movable-side pressure position, the movable-side pressure lever 52 is disengaged from the movable-side engagement part 82 of the outside cover 17 at the closed position.

The movable-side pressure lever 52 thus rotates in the opposite direction as the closing direction and moves to the movable-side pressure position in conjunction with rotation of the outside cover 17 in the closing direction. When the outside cover 17 has reached the closed position and the movable-side pressure lever 52 has reached the movable-side pressure position, the movable-side pressure lever 52 and the outside cover 17 do not touch.

As described above in a printer 10 according to this embodiment of the invention, the stationary-side pressure lever 32 rotates in the closing direction and moves to the movable-side pressure position, and the movable-side pressure lever 52 rotates to the opposite side as the closing direction and moves to the movable-side pressure position even if the user closes the outside cover 17 while either or both of the stationary-side pressure lever 32 and the movable-side pressure lever 52 is at the release position. More specifically, The stationary-side pressure lever 32 and movable-side pressure lever 52, which rotate in opposite directions, can be set to the stationary-side pressure position and the movable-side pressure position, respectively, by simply closing the outside cover 17. The roll paper P being conveyed while the stationary-side pressure lever 32 and movable-side pressure lever 52 are not at the stationary-side pressure position and the movable-side pressure position can be prevented without the user performing a complicated operation.

Furthermore, in a printer 10 according to this embodiment of the invention, regardless of where the movable-side pressure lever 52 is positioned on the left-right axis, the movable-side engagement part 82 engages the movable-side pressure lever 52 at the movable-side release position when the outside cover 17 rotates from the open position to the closed position, and the movable-side pressure lever 52 therefore rotates to the movable-side pressure position. As a result, the movable-side pressure lever 52 can be set to the movable-side pressure position by simply closing the outside cover 17. Therefore, the roll paper P being conveyed when the movable-side pressure lever 52 is not at the movable-side pressure position can therefore be prevented without the user performing a complicated operation.

Because the hinge 18 of the outside cover 17 is located substantially directly above the stationary-side pressure lever 32 (see FIG. 4), the stationary-side engagement part 81 engages the stationary-side pressure lever 32 on the stationary-side media pressure parts 36 side of the axis of rotation, and the construction of the printer 10 makes rotating the stationary-side pressure lever 32 in the same direction as the closing direction difficult. However, because the stationary-side engagement receiving member 46 engages the stationary-side engagement part 81 on the opposite side of the axis of rotation of the stationary-side pressure lever 32 as the stationary-side media pressure parts 36, the stationary-side pressure lever 32 can be rotated in the same direction as the closing direction.

Note that the movable-side pressure lever 52 may be configured so that the movable-side engagement part 82 engages the movable-side pressure lever 52 on the opposite side of the axis of rotation as the movable-side media pressure parts 56.

When the outside cover 17 is at the closed position, the outside cover 17 and the stationary-side pressure lever 32 are not touching, and the outside cover 17 and the movable-side pressure lever 52 are not touching. As a result, when the printing process is executed with the outside cover 17 at the closed position, vibration or other external disturbance of the outside cover 17 can be prevented from affecting conveyance of the roll paper P through the stationary-side pressure lever 32 or movable-side pressure lever 52.

When the outside cover 17 is not completely closed, that is, when the outside cover 17 is not at the closed position, the control unit of the printer 10 prohibits the printing process.

Figure 10:
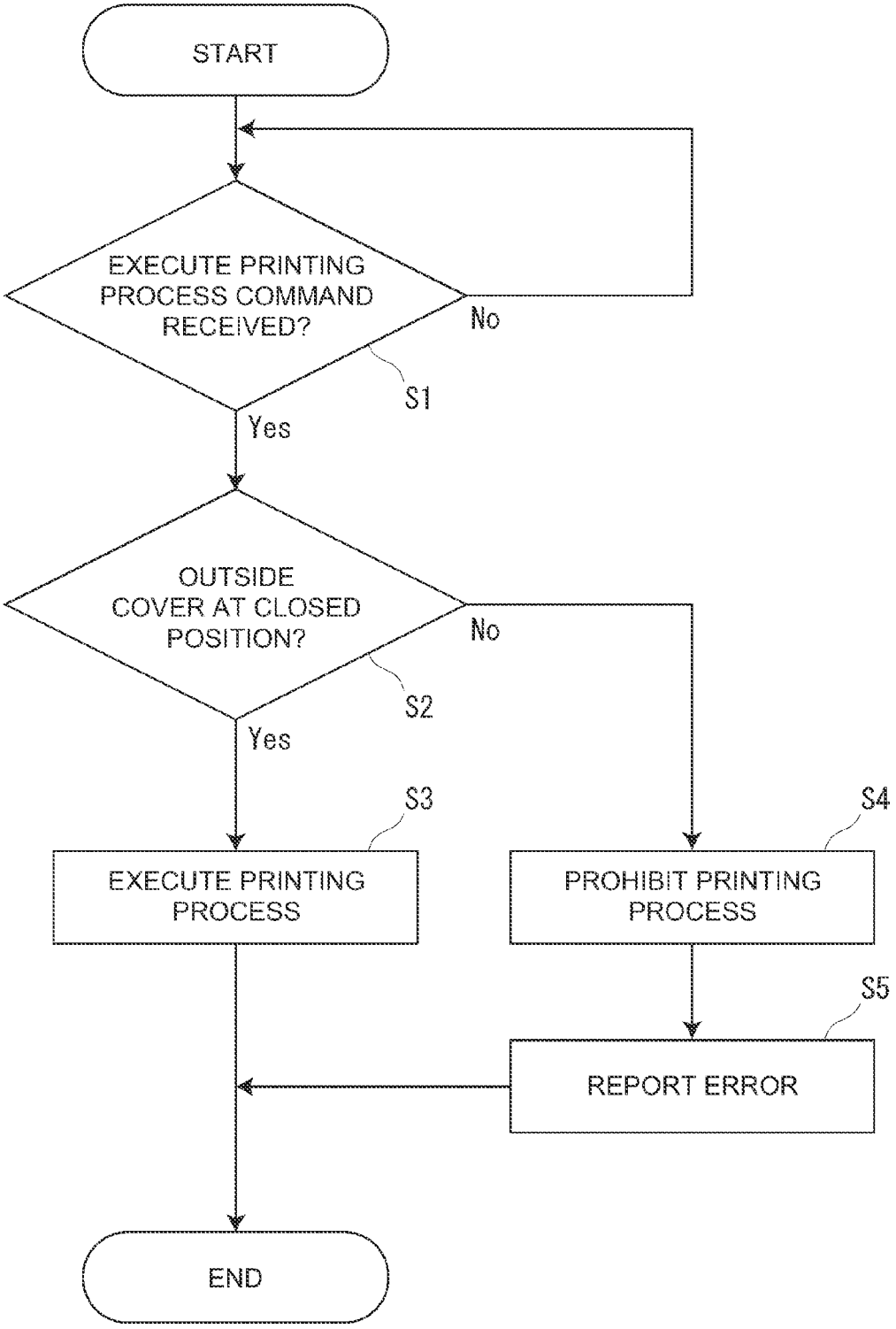
FIG. 10 is a flow chart describing the printing process in the printer.

As shown in FIG. 10, the control unit determines if a command to execute the printing process is received from the information processing device (S1). If the control unit determines a command to execute the printing process was received (S1 returns YES), the control unit determines if the outside cover 17 is at the closed position based on the detection result from the open/closed detection sensor (S2). If the control unit determines the outside cover 17 is in the closed position, the control unit executes the printing process (S3). If the control unit determines the outside cover 17 is not in the closed position, the control unit prohibits the printing process (S4). More specifically, the control unit prohibits driving the conveyance unit 22 and print unit 23. If the printing process is prohibited, the control unit reports an error on the display and operating panel 12 (S5).

The control unit thus prohibits driving the conveyance unit 22 when the open/closed detection sensor detects that the outside cover 17 is not in the closed position. Therefore, the stationary-side pressure lever 32 and movable-side pressure lever 52 therefore remain at the stationary-side release position and the movable-side release position if the user forgets to return the stationary-side pressure lever 32 and movable-side pressure lever 52 to the stationary-side pressure position and the movable-side pressure position, and also forgets to close the outside cover 17, but because driving the conveyance unit 22 is prohibited, the roll paper P can be prevented from being conveyed when the stationary-side pressure lever 32 and movable-side pressure lever 52 are not at the stationary-side pressure position and the movable-side pressure position.

Note that the foregoing embodiment describes a configuration having a stationary guide 31 and a movable guide 51, but the invention is not so limited and both could be a movable guide 51, for example. Furthermore, roll paper is used as an example of the print medium above, but the invention is not so limited and the print medium may be fanfold paper, for example. In this event, the fanfold paper is inserted from a paper entrance (not shown in the figure) disposed in the rear panel of the case 11.

The invention being thus described, it will be obvious that it may be varied in many ways. Such variations are not to be regarded as a departure from the spirit and scope of the invention, and all such modifications as would be obvious to one skilled in the art are intended to be included within the scope of the following claims.

What is claimed is:

1. A printing device comprising:

an outside cover configured to rotate in a closing direction from an open position where the inside of the printing device is open to a closed position where the inside of the printing device is closed;

a first pressure lever configured to rotate in the same direction as the closing direction in conjunction with rotation of the outside cover in the closing direction, and presses a print medium to a conveyance path surface; and a second pressure lever configured to rotate in the opposite direction as the closing direction in conjunction with rotation of the outside cover in the closing direction, and presses the print medium to the conveyance path surface.

2. The printing device described in claim 1, wherein:

the first pressure lever has a first media pressure part that presses the print medium to the conveyance path surface;

the first pressure lever configured to move in conjunction with rotation of the outside cover in the closing direction from a first release position where the first media pressure part is separated from the conveyance path surface, to a first pressure position where the first media pressure part presses the print medium to the conveyance path surface;

the second pressure lever has a second media pressure part that presses the print medium to the conveyance path surface; and the second pressure lever configured to move in conjunction with rotation of the outside cover in the closing direction from a second release position where the second media pressure part is separated from the conveyance path surface, to a second pressure position where the second media pressure part presses the print medium to the conveyance path surface.

3. The printing device described in claim 2, wherein:

the outside cover has a first engaging part configured to engage the first pressure lever set to the first release position and rotate the first pressure lever in the same direction as the closing direction when the outside cover rotates in the closing direction from the open position, and a second engaging part configured to engage the second pressure lever set to the second release position and rotate the second pressure lever in the opposite direction as the closing direction when the outside cover rotates in the closing direction from the open position.

4. The printing device described in claim 3, wherein:

the first pressure lever has a lever main to which the first media pressure part is disposed, and an engagement receiving part that the first engaging part engages;

the engagement receiving part is configured to engage the first engaging part on the opposite side of the axis of rotation of the first pressure lever as the first media pressure part.

5. The printing device described in claim 3, wherein:

the second engaging part is configured to engage the second pressure lever on the opposite side of the axis of rotation of the second pressure lever as the second media pressure part.

6. The printing device described in claim 4, wherein:

the lever main and the engagement receiving part are formed in unison.

7. The printing device described in claim 3, wherein:

the first engaging part of the outside cover in the closed position is disengaged from the first pressure lever moved to the first pressure position; and the second engaging part of the outside cover in the closed position is disengaged from the second pressure lever moved to the second pressure position.

8. The printing device described in claim 7, further comprising:

a first elastic member that urges the first pressure lever to the first pressure position and the first release position from a neutral position between the first pressure position and the first release position; and a second elastic member configured to urge the second pressure lever to the second pressure position and the second release position from a neutral position between the second pressure position and the second release position.

9. The printing device described in claim 1, further comprising:

a conveyance unit that conveys the print medium;

an open/closed detection sensor that detects whether or not the outside cover is at the closed position; and a control unit configured to prohibit driving the conveyance unit when the open/closed detection sensor detects that the outside cover is not at the closed position.

10. The printing device described in claim 1, further comprising:

a first guide unit that guides one edge of the width of the print medium; and a second guide unit that guides the other edge of the width of the print medium;

wherein the first pressure lever is disposed to the first guide unit, and the second pressure lever is disposed to the second guide unit.

11. A printing device comprising:

a movable guide configured to move in a transverse direction perpendicular to the conveyance direction of a print medium, and guide a side edge of the print medium;

a pressure lever including a pressure part that presses the print medium to the conveyance path surface, is disposed to the movable guide rotatably between a release position where the pressure part is separated from the conveyance path surface, and a pressure position where the print medium is pressed to the conveyance path surface by the pressure part, and moves in the transverse direction in conjunction with movement of the movable guide; and an outside cover including an engaging part that engages the pressure lever in the release position and rotates the pressure lever to the pressure position when the outside cover rotates in a closing direction from an open position where the inside of the printing device is open to a closed position where the inside of the printing device is closed;

the engaging part is configured to engage the pressure lever wherever the pressure lever is located in the range of movement on the transverse axis.

* * * * *